United States Patent [19]

Tucker

[11] 4,227,462

[45] Oct. 14, 1980

[54] LOCK OUT PROXIMITY FUZE AMPLIFIER

[75] Inventor: Robert W. Tucker, Rockville, Md.

[73] Assignee: The United States of America as represented by the Secretary of the Army, Washington, D.C.

[21] Appl. No.: 553,359

[22] Filed: Feb. 28, 1975

[51] Int. Cl.[3] ..... F42C 11/00; H03K 5/22; H03K 17/00

[52] U.S. Cl. ..... 102/220; 307/231; 328/99; 328/114

[58] Field of Search ..... 102/70.2 R, 220; 307/231, 252 A; 328/99, 114

[56] References Cited

U.S. PATENT DOCUMENTS

| | | | |
|---|---|---|---|
| 3,260,861 | 7/1966 | Dalley | 328/99 X |
| 3,316,451 | 4/1967 | Silberman | 102/70.2 R X |
| 3,424,924 | 1/1969 | Leisinger et al. | 102/70.2 R X |
| 3,665,860 | 5/1972 | West | 102/70.2 R |
| 3,808,459 | 4/1974 | Guimier | 102/70.2 R X |

*Primary Examiner*—Malcolm F. Hubler
*Attorney, Agent, or Firm*—Nathan Edelberg; Robert P. Gibson

[57] ABSTRACT

A discriminator circuit having utility in proximity fuze firing circuits is capable of distinguishing between spurious and proper signals on the basis of both amplitude and rate of amplitude rise. A firing switch, operated by a slow-charging trigger circuit, and a lock out switch, operated by a fast-charging trigger circuit, are both triggered by the same signal. If the rate of input signal envelope rise is faster than that for a proper firing signal, the lock out switch fires and inhibits triggering of the firing switch. The trigger circuits are biased to permit the firing switch to be triggered before the lock out switch when the input signal rate of rise is slow enough to be followed by the slow-charging trigger circuit. For signal rates of rise which are slower than that associated with a proper signal, a capacitor in the slow-charging trigger circuit becomes charged to block triggering of the firing switch.

10 Claims, 2 Drawing Figures

LOCK OUT PROXIMITY FUZE AMPLIFIER

RIGHTS OF THE GOVERNMENT

The invention described herein may be manufactured, used, and licensed by or for the United States Government for governmental purposes without the payment to me of any royalty thereon.

BACKGROUND OF THE INVENTION

The present invention relates to signal discriminator circuits and, more particularly, to an amplitude and rise time discriminator. In a specific embodiment disclosed herein, the discriminator is employed to detect the proper firing signal for detonation of a proximity fuze; however, it will be apparent to those in the art of electronic circuits that the scope of the present invention is not limited to fuze firing.

A major problem associated with proximity fuzes relates to premature firing which results in complete loss of the fired round. In addition, although premature firings cannot inflict casualties on friendly troops, they do constitute a psychological factor in the reluctance of troops to use proximity fuzes. It is therefore desirable to eliminate premature firing. A major cause of premature firing is spurious signals received at the fuze firing circuit. Such signals may result from enemy jamming operations or from within the fuze unit itself, such as by component failure, broken leads, or acoustic pick up.

There has been very little research conducted heretofore into the nature of the spurious signals which cause premature firings. I have discovered, however, that a substantial number of premature firings are initiated by burst-like spurious signals having an amplitude envelope with a significantly faster rate of rise than the amplitude envelope of the proper firing signal. Still other premature firings are initiated by signals with amplitude envelopes exhibiting a much slower rate of rise than the proper firing signal. More specifically, the proper firing signal is a sinusoidal signal which increases in amplitude at some predetermined exponential rate to a maximum amplitude. The spurious signals in question also increase to that maximum amplitude but at substantially faster or slower exponential rates than that exhibited by the proper firing signal. Since the proper and spurious signals achieve the same level, it is impossible to discriminate between them on the basis of amplitude alone. I have therefore devised a circuit which discriminates between signals on the basis of both amplitude and rate of amplitude rise.

It is therefore an object of the present invention to provide a circuit which is capable of discriminating between signals on the basis of both amplitude and rate of amplitude change.

It is another object of the present invention to provide a discriminator circuit for detecting signals reaching a predetermined amplitude and exhibiting a rate of amplitude rise lying within a predetermined range of rates.

It is another object of the present invention to provide an amplitude discriminator circuit which provides an output signal only when the amplitude rate of rise is slower than a first predetermined rate and faster than a second predetermined rate.

It is still another object of the present invention for providing a firing circuit for proximity fuze which discriminates against suprious signals and fires only in response to a firing signal of a least a predetermined amplitude and having a rate of amplitude rise within a predetermined range of rates.

SUMMARY OF THE INVENTION

In accordance with the present invention, a firing electronic switch is actuated in response to a signal of at least a threshold amplitude and having an amplitude rate of rise which is within a predetermined range of rates. A lock out switch includes a fast-charging trigger circuit which renders the lock out switch conductive relatively shortly after an input signal reaches a predetermined amplitude. When conducting, the lock out switch inhibits triggering of the firing switch. For input signals with fast rates of rise, a relatively slow-charging trigger circuit for the firing switch is incapable of triggering the firing switch before the lock out switch is triggered. However, for proper firing signals having slow rates of rise, the slow-charging trigger circuit follows the signal as quickly as the fast-charging trigger circuit, in which case the firing switch is biased to trigger at a lower level than, and hence before, the lock out switch. For input signals exhibiting slower rise rates than a proper firing signal, a capacitor in the slow-charging trigger circuit blocks triggering of the firing switch.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein.

DESCRIPTION OF PREFERRED EMBODIMENTS

Figure 1:
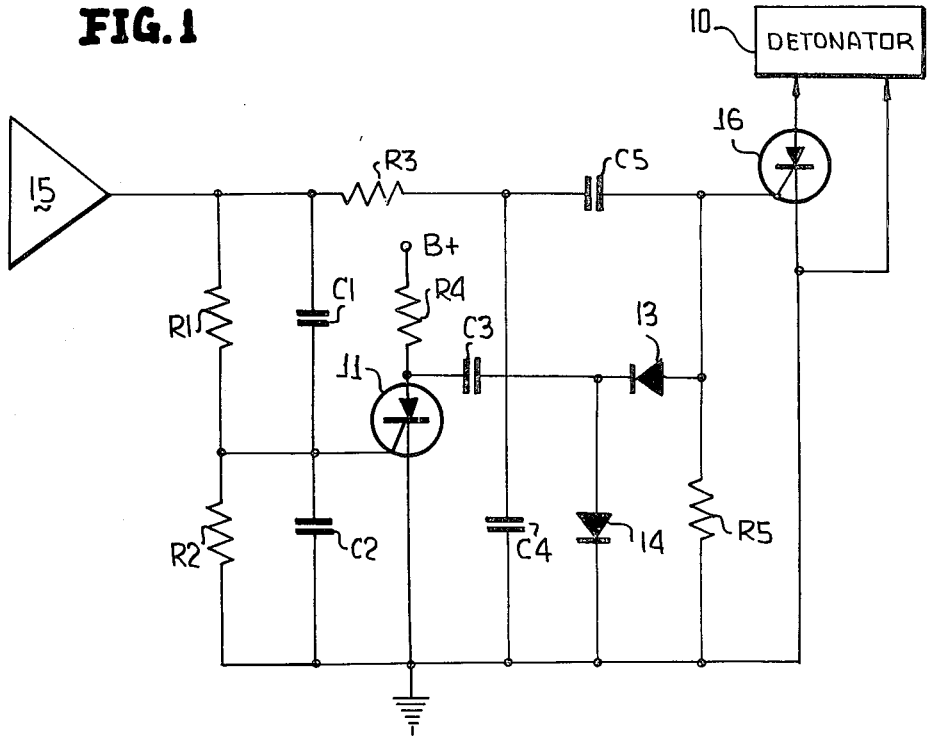
FIG. 1 is a schematic diagram of one embodiment of the discriminator circuit of the present invention.

Referring specifically to FIG. 1 of the accompanying drawings, the discriminator circuit of the present invention is illustrated as receiving a signal from an amplifier 15. The circuit includes two active elements, namely lock out SCR 11 and normal or firing SCR 16. The anode of lock out SCR 11 is resistively coupled to positive supply voltage B+ via resistor R4; the cathode of SCR 11 is connected to circuit ground. The anode-cathode circuit of firing SCR 16 serves as a switch for a conventional electrical fuze detonator 10 across which SCR 16 is connected. The cathode of SCR 16 is also connected to circuit ground.

A resistive voltage divider R1, R2 and a capacitive voltage divider C1, C2 are connected in parallel with one another between the signal output terminal of amplifier 15 and circuit ground. The gate electrode of lock out SCR 11 is coupled to the junction between resistors R1 and R2 and the junction between capacitors C1 and C2.

The signal output terminal of amplifier 15 is connected to a series circuit comprising a resistor R3, a capacitor C5 and a resistor R5 which is returned to circuit gound. The gate electrode of firing SCR 16 is connected to the junction between capacitor C5 and resistor R5. A further capacitor C4 is coupled between circuit ground and the junction of resistor R3 and capacitor C5. A pair of diodes 13, 14 are connected in series between the gate of SCR 16 and ground with the anode of diode 13 connected to the SCR gate and the cathode of diode 14 connected to ground. A capacitor C3 is connected between the anode of lock out SCR 11 and the junction of diodes 13, 14.

With the circuit at rest and no output signal provided by amplifier 15, capacitor C3 charges to the supply voltage B+ via resistor R3 and diode 14. It is assumed herein that amplifier 15 provides an output signal in the form of an exponentially increasing sinusoid which reaches a maximum voltage and then saturates and remains constant for some finite interval. If the rate of rise of the envelope of that signal is faster than that of a proper fuze-firing signal, the time constants of the circuit are arranged to cause lock out SCR 11 to trigger before the firing SCR 16 can be triggered. More specifically, lock out SCR is triggered by the voltage across capacitor C2 in the capacitive voltage divider C1, C2, it being noted that these capacitors charge up relatively quickly due to the absence of significant resistance in their charge path. On the other hand, the trigger circuit for firing SCR 16 includes resistor R3 and capacitor C4 which are selected to have a time constant which is commensurate with the rate of rise of a proper firing signal and, in any event, which is too slow to trigger SCR 16 before SCR 11 is triggered by a signal having a fast rate of rise. When lock out SCR 11 is triggered, the left-hand side of capacitor C3 is coupled to ground through the anode-cathode circuit of the SCR. Since capacitor C3 is initially charged to B+, the right-hand side of capacitor C3 becomes negative. This drives the gate of firing SCR 16 negative initially so that triggering of SCR 16 is inhibited. Capacitor C3 begins to discharge, with discharge current flowing through resistor R5, diode 13, capacitor C3 and SCR 11 to ground. The discharge time constant provided by resistor R5 and capacitor C3 is sufficiently long to permit capacitor C5 to charge up to the saturated signal level provided by amplifier 15. When so charged capacitor C5 effectively decouples the gate from the signal to prevent triggering of firing SCR 16. In this manner, a signal having a fast amplitude envelope rise is precluded from triggering firing SCR 16 and detonator 10, even though the signal amplitude exceeds the threshold level required for a proper firing signal.

Now assume that the output signal provided by amplifier 15 is a proper firing signal, whereby the amplitude rises exponentially to exceed the firing threshold at a rate of rise which is within a prescribed range of rates. The time constant defined by resistor R3 and capacitor C4 is chosen to permit the voltage across capacitor C4 to contemporaneously follow the more slowly rising signal. Consequently, the voltage appearing across resistor R5, upon reaching the triggering threshold for SCR 16, triggers that SCR to activate detonator 10. The lock out SCR 11 is biased by proper ratios of resistors R1 and R2 and capacitors C1 and C2 to assure that SCR 11 is not triggered before SCR 16 in response to the slowly rising signal.

If the output signal from amplifier 15 exhibits a rate of rise which is slower than that permitted for a proper firing signal, capacitor C5 charges contemporaneously with the signal, preventing any significant triggering voltage from appearing across resistor R5 and the gate of SCR 16. When fully charged to the saturated level capacitor C5 blocks application of triggering signal to the gate of SCR 16.

As described, diode 14 serves to prevent the initial charging current for capacitor C3 from triggering SCR 16. Diode 13 serves to pull the gate of SCR 16 negative when lock out SCR 11 conducts.

In accordance with the foregoing description, SCR 16 is prevented from firing when the rate of amplitude rise of the signal from amplifier 15 is faster or slower than a prescribed range of rates. By way of example only, the following Table I lists typical component values for the circuit of FIG. 1 which permit such operation to ensue:

TABLE I

| Component | Value |
|---|---|
| R1 | 43K ohms |
| R2 | 6.8K ohms |
| R3 | 33K ohms |
| R4 | 100K ohms |
| R5 | 15K ohms |
| C1 | 1.0 uf |
| C2 | 2.0 uf |
| C3 | 10.0 uf |
| C4 | 1.0 uf |
| C5 | 10.0 uf |
| Diodes 13, 14 | 1N461 |
| SCR;s 11, 16 | 3N84 |
| Amplifier 15 | Sprague Model ULN2302 |

Figure 2:
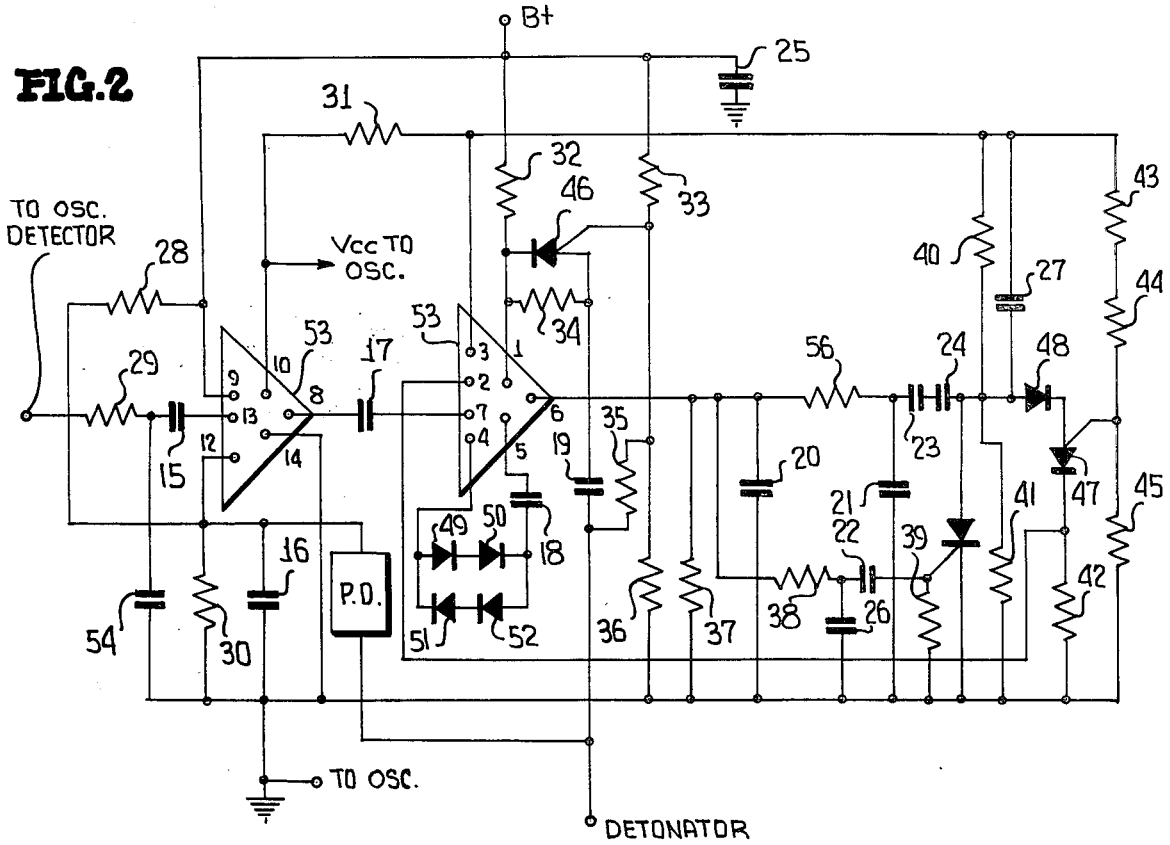
FIG. 2 is a schematic diagram of another embodiment of the discriminator circuit of the present invention.

Another embodiment of the invention is illustrated in FIG. 2. This embodiment is designed to be employed with a commercially available integrated circuit such as model number ULN 2302 manufactured by the Sprague Electric Co., North Adams, Mass. This circuit is represented by reference numeral 53 and is shown in the form of two amplifiers (with appropriate pin numbers 1–10, 12–14) for convenience. In this manner the circuit 53 may be considered as two amplifier stages for the detected firing signal which is applied to the first stage at pin 13 through series-connected resistor 29 and capacitor 15. The output firing signal from circuit 53 is taken from terminal 6 of the second stage. Circuit 53 also includes an SCR (not shown) having an anode connected to pin 1, a cathode connected to pin 14 (circuit ground) and a gate electrode connected to pin 2. As will become evident from the following description, triggering of this SCR in circuit 53 results in firing of the fuze.

As mentioned, the firing signal (in the form of an exponentially increasing sinusoid) is applied to the first amplifier stage of circuit 53 through series-connected resistor 29 and capacitor 15. The junction between these two elements is capacitively coupled to ground through capacitor 54.

A positive supply voltage B+ is connected to pin 9 of circuit 53 and across a voltage divider comprising series-connected resistors 28 and 30. A capacitor 16 is connected in parallel across resistor 30 to ground. Impact switch PD is connected between the fuze detonator and the junction between resistors 28 and 30, which junction is also connected to pin 12 of circuit 53.

Capacitive coupling between amplifier stages in circuit 53 is provided by capacitor 17 connected between pins 8 and 7. The voltage at pin 10 is a bias voltage (Vcc) for the firing circuit and is derived internally of circuit 53 from the B+ voltage applied at pin 9. The Vcc voltage is applied through voltage-dropping resistor 31 to pin 3 of circuit 53 (to provide a bias voltage for the amplifier stages therein) and to the firing circuitry. Specifically, resistor 31 is returned to ground through a first voltage divider comprising series-connected resistors 40 and 41, and a second voltage divider comprising series-connected resistors 43, 44 and 45. A capacitor 27 is connected across resistor 40.

The B+ supply voltage is also connected across a smoothing capacitor 25, a voltage divider comprising series-connected resistors 33 and 36, and to one end of resistor 32 which has its other end connected to pin 1 of circuit 53. Pin 1 is also connected to the cathode of unijunction transistor (UJT) 46, the anode of which is connected through capacitor 19 and resistor 35 in series to the junction between resistors 33 and 36. Resistor 34 is connected across the anode-cathode circuit of UJT 46.

A first pair of series-connected diodes 49, 50 are connected in inverse parallel relationship with another pair of series-connected diodes 51, 52. The inverse parallel circuit is connected in series with capacitor 18 between pins 4 and 5 of circuit 53. The function of these diodes and capacitor 18 is to provide negative feedback in the amplifier of circuit 53, resulting in a logarithmic gain characteristic and some amplitude compression. This amplitude compression is utilized to emphasize the difference between the amplitude rates of rise of an abrupt or spurious noise burst and the proper signal.

The output pin 6 of circuit 53 is returned to ground through resistor 37 and capacitor 20 connected in parallel. In addition, pin 6 is connected to a series circuit comprising resistor 56, capacitors 23, 24, diode 48, UJT 47 and resistor 42; the anode of UJT 47 being coupled to the cathode of diode 48, and resistor 42 being returned to ground. The gate of UJT 47 is connected to the junction between resistors 44 and 45. The anode of diode 48, in addition to being connected to capacitor 24, is connected to the junction between resistors 40 and 41. A capacitor 21 is connected between ground and the junction of resistor 56 and capacitor 23.

An SCR 55 has its anode-cathode circuit connected across resistor 41. Signal from pin 6 of circuit 53 is coupled to the gate of SCR 55 via series-connected resistor 38 and capacitor 22. The gate of SCR 55 is also returned to ground through resistor 39. A capacitor 26 is connected between ground and the junction of resistor 38 and capacitor 22. The cathode of UJT 47 is connected to pin 2 of circuit 53 which in turn is connected to the gate of the firing SCR internally of circuit 53. Thus, when UJT 47 is triggered on, the firing SCR is triggered on to provide a short circuit between pins 1 and 14 in circuit 53.

Resistor 29 and capacitor 54 serve as an input filter and provide high frequency band-shaping. Capacitors 15 and 17 combine with the input resistances of the two amplifier stages of circuit 53 (approximately 80 Kohms and and 10 Kohms, respectively) to provide low frequency band-shaping. Resistors 28 and 30 and capacitor 16 serve as a ripple filter. The PD switch is an impact switch which closes if the missile impacts against a target or the ground, permitting capacitor 16 to discharge through the switch and actuate the detonator.

UJT 46 serves as an initial arming delay switch for the firing circuit, its cathode being connected directly to the anode of the firing SCR in circuit 57 via pin 1. In other words, inhibiting triggering of UJT 46 for a short interval after power turn on assures that turn on transients cannot inadvertently trigger the firing SCR. This is accomplished by appropriate choice of component values for resistors 32, 34, 35 and 36 and capacitor 19. Specifically, with resistors 32 and 34 much larger than resistors 35 and 36, the voltage at the anode of UJT 46 is initially too low relative to the gate voltage to sustain conduction of the UJT. However, when capacitor 19 charges, the anode of UJT 46 is at a level approximately 0.5 volt lower than the voltage at the gate. At this point UJT 46 is ready to conduct when the firing SCR in circuit 53 is triggered.

UJT 47 is a signal level sensor which, when triggered, triggers the firing SCR in circuit 53. Diode D5 provides temperature compensation. The output signal at pin 6 is integrated by capacitors 20, 21 and resistor 56. The integrated signal is then differentiated by capacitors 23, 24 and resistors 40, 41. When the voltage at the anode of UJT 47 exceeds the offset level of the gate, UJT 47 is triggered on to permit current flow through resistor 45. This in turn triggers the firing SCR in circuit 53 to actuate the detonator.

The lock out feature is provided by lock out SCR 55. Specifically, the trigger circuit for SCR, including resistors 38 and 39 and capacitors 22 and 26, has a faster response time to fast-rising signals then the trigger circuit for UJT 47.

Operation of the circuit of FIG. 2, in basic theory, follows operation of the circuit of FIG. 1. If the signal at pin 6 of circuit 53 has a faster rate of rise than that of a proper firing signal, SCR 55 is triggered before UJT 47 and presents a short circuit from the anode of diode 48 to ground to prevent triggering of the UJT. On the other hand, a proper firing signal has a rate of rise which is followed by the trigger circuit for UJT 47 so that the UJT triggers before SCR 55. When UJT 47 triggers, the firing SCR in circuit 53 fires to actuate the detonator.

By way of example only, Table II lists typical component values for the circuit of FIG. 2 which permit the desired operation to ensue:

TABLE II

| Component | | Value |
|---|---|---|
| Resistor | 28 | 150K ohms |
| " | 29 | 9.1K ohms |
| " | 30 | 2.7M ohms |
| " | 31 | 820 ohms |
| " | 32 | 100K ohms |
| " | 33 | 10K ohms |
| " | 34 | 220K ohms |
| " | 35 | 1M ohm |
| " | 36 | 20K ohms |
| " | 37 | 33K ohms |
| " | 38 | 8.2K ohms |
| " | 39 | 10-30K ohms |
| " | 40 | 510K ohms |
| " | 41 | 220K ohms |
| " | 42 | 510 ohms |
| " | 43 | 10-15K ohms |
| " | 44 | 15K ohms |
| " | 45 | 10K ohms |
| " | 56 | 10K ohms |
| Capacitor | 15 | .0022 uf |
| " | 16 | 3.3 uf |
| " | 17 | .015 uf |
| " | 18 | 0.1 uf |
| " | 19 | 3.3 uf |
| " | 20 | 0.1 uf |
| " | 21 | 0.22 uf |
| " | 22 | 0.33 uf |
| " | 23 | 1.0 uf |
| " | 24 | 1.0 uf |
| " | 25 | .0022 uf |
| " | 26 | 0.15 uf |
| " | 27 | 0.47 uf |
| " | 54 | .001 uf |
| Diodes 48-52 | | IN461 |
| UJT 46, 47 | | D13T1 |
| SCR 55 | | 3N84 |

I wish it to be understood that I do not desire to be limited to the exact details of construction shown and described, for obvious modifications can be made by a person skilled in the art.

I claim:

1. A rise time discriminator circuit for detecting an applied input signal having an amplitude envelope which increases to a predetermined level at a rate which is slower than a first specified rate, said discriminator circuit comprising:

an actuable normal electronic switch;

an actuable lock out electronic switch;

a first trigger circuit for said normal electronic switch, said first trigger circuit including first resistive means and first capacitive means connected such that said first capacitive means is charged through said first resistive means by said input signal, said first resistive means and first capacitive means having a time constant which is sufficiently long to cause the charge on said first capacitive means to substantially lag the amplitude envelope of said input signal for signal envelope increase rates faster than said first specified rate;

a second trigger circuit for said lock out electronic switch, said second trigger circuit including second resistive means and second capacitive means connected such that said second capacitive means is charged through said second resistive means by said input signal, said second resistive means and second capacitive means having a time constant which is sufficiently short to permit the charge on said second capacitive means to rapidly follow the amplitude envelope for signal envelope increase rates faster than said first specified rate;

first voltage-dividing bias means responsive to the charge on said first capacitive means reaching said predetermined level for actuating said normal electronic switch;

second voltage-dividing bias means responsive to the charge on said second capacitive means exceeding said predetermined level for actuating said lock out electronic switch; and inhibiting means responsive to actuation of said lock out electronic switch for inhibiting actuation of said normal electronic switch.

2. The rise time discriminator circuit according to claim 1 employed in a fuze firing circuit further comprising a detonator and means responsive to actuation of said normal electronic switch for firing said detonator.

3. The rise time discriminator circuit according to claim 1 wherein said normal and lock out electronic switches are first and second silicon controlled rectifiers, respectively, each including anode, cathode and gate electrodes, said first bias circuit being connected to the gate electrode of said first silicon controlled rectifier, said second bias circuit being connected to the gate electrode of said second silicon controlled rectifier, further comprising utilization means connected in the anodecathode circuit of said first silicon controlled rectifier, and wherein said inhibiting means is connected between the gate electrode of said first silicon controlled rectifier and the anode-cathode circuit of said second silicon controlled rectifier.

4. The rise time discriminator circuit according to claim 3 wherein said inhibiting means comprises:

a source of supply voltage;

a resistor and capacitor connected at a junction in series between said source and circuit ground;

means connecting the anode of said second silicon controlled rectifier to said junction; and means connecting the gate electrode of said first silicon controlled rectifier to the side of said capacitor opposite said junction.

5. The rise time discriminator circuit according to claim 4 wherein said utilization means comprises a detonator fuze.

6. The rise time discriminator circit according to claim 3 employed in a fuze firing circuit further comprising a detonator and means responsive to actuation of said normal electronic switch for firing said detonator.

7. The rise time discriminator circuit according to claim 1 wherein said lock out electronic switch comprises a silicon controlled rectifier.

8. The rise time discriminator circuit according to claim 7 wherein said normal electronic switch comprises a unijunction transistor.

9. The rise time discriminator circuit according to claim 8 wherein said silicon controlled rectifier and said unijunction transistor each have anode, cathode and gate electrodes, and wherein said inhibiting means comprises means connecting the anode of said silicon controlled rectifier to the anode of said unijunction transistor and means connecting the cathode of said silicon controlled rectifier to circuit ground, such that said silicon controlled rectifier, when actuated, effectively shorts the anode of said unijunction transistor to ground.

10. The rise time discriminator circuit according to claim 9 employed in a fuze firing circuit further comprising a detonator and means responsive to actuation of said normal electronic switch for firing said detonator.

* * * * *